United States Patent [19]

Schatz et al.

[11] Patent Number: 4,492,376

[45] Date of Patent: Jan. 8, 1985

[54] LOWER EXTREMITY EXERCISER

[76] Inventors: Jack M. Schatz, 403 W. Harding Rd., Lombard, Ill. 60148; Robert S. Gajda, 5921 Meadow La., Lisle, Ill. 60532

[21] Appl. No.: 481,407

[22] Filed: Apr. 1, 1983

[51] Int. Cl.[3] ..... A63B 21/00

[52] U.S. Cl. ..... 272/138; 272/135; 272/136; 272/144; 272/145

[58] Field of Search ..... 272/125, 126, 135–139, 272/142, 144, 145, 93

[56] References Cited

U.S. PATENT DOCUMENTS

| | | | |
|---|---|---|---|
| 1,950,174 | 3/1934 | Harrison | 272/134 |
| 3,947,023 | 3/1976 | Martin | 272/93 |
| 4,198,044 | 4/1980 | Holappa | 272/144 X |
| 4,311,305 | 1/1982 | Lambert, Jr. et al. | 272/134 X |

OTHER PUBLICATIONS

Dominguez and Gajda, "Total Body Training", Warner Books, 1983, pp. 185–206, 260–268.

*Primary Examiner*—Robert A. Hafer
*Assistant Examiner*—Chris Coppens
*Attorney, Agent, or Firm*—Lee, Smith & Zickert

[57] ABSTRACT

An improved lower extremity exercise device has a planar bed and support members which form a channel and storage chamber. An elongate support member is positioned below an edge of the bed and forms a shoulder. The elongate member includes vertical sockets and horizontal apertures. Tubular pegs are inserted in the sockets and apertures in sequences selected by the user. Elastic bands are looped around the pegs and portions of the body for the performance of exercises. The shoulder provides a proper heel-resting surface for certain exercises. A slidable bar is positioned in the channel and can be moved outwardly and secured at a pre-selected extension. The outward end of the bar is also engageable with elastic bands and allows additional exercises to be performed. The improved device is portable and provides storage for pegs and bands.

11 Claims, 13 Drawing Figures

36
18
39
37
43
37
17
3.
36
10
28
36
28
19
28
36
28
39
29
33
11
30
4.
39
35
44
12
3.
39
29
39
35
44

44
16
11
44
26
21
24
22
39
29
30
34
31
14
15
30
34
42
29
39
35
20
32
13
37
25
28
23
28
28
39
26
26
10
41
42
40
40
35
40'
40
43
17

39
37
28
10
12
11
33
34
14
42
41
42
19
18
44
13
39
16
24
31
15
30
32
25
26
28
17

27
35
12
11
29
33
34
15
31
32
30
26

Fig. 5.
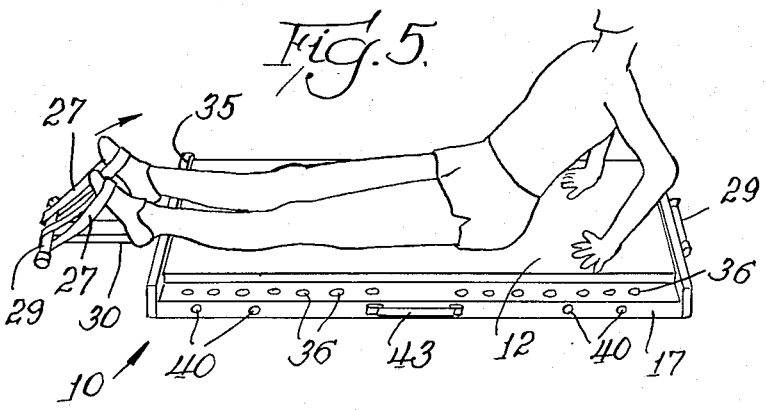
Fig. 8.
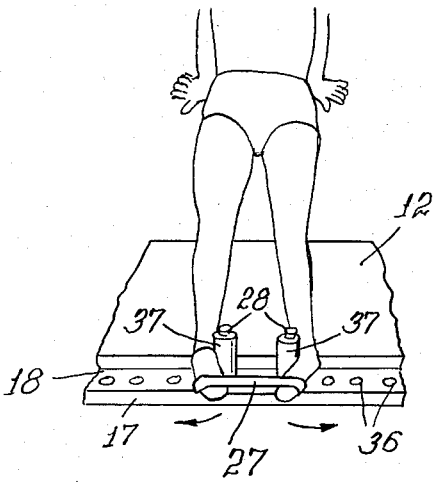
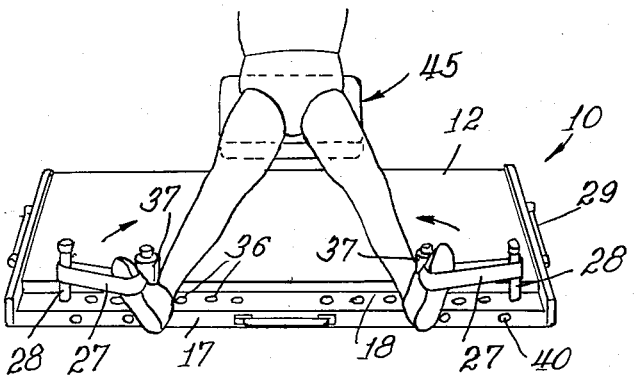
Fig. 6.
Fig. 7.
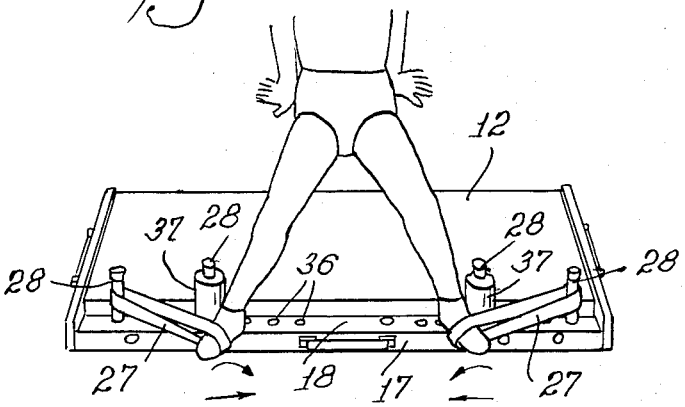
Fig. 9.
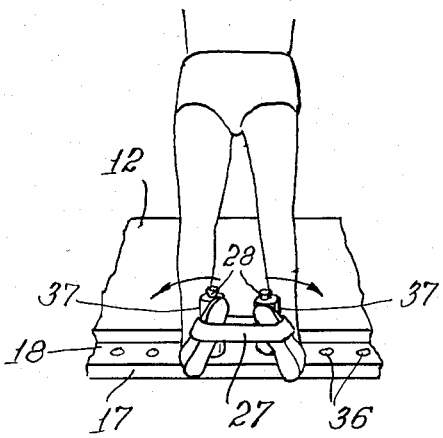

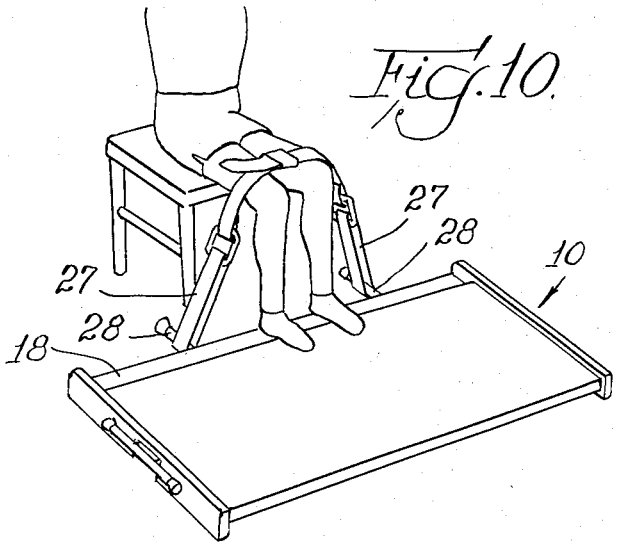
Fig. 10.
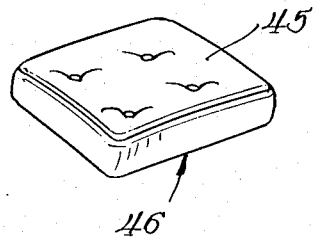
Fig. 12.
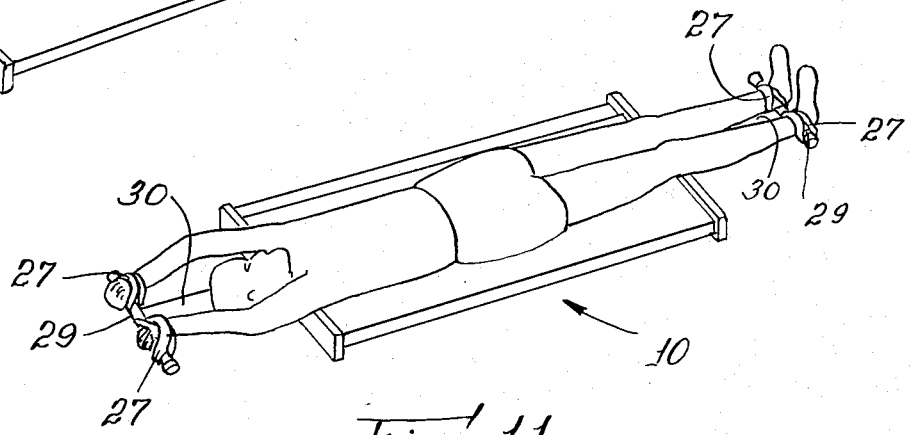
Fig. 11.
Fig. 13.
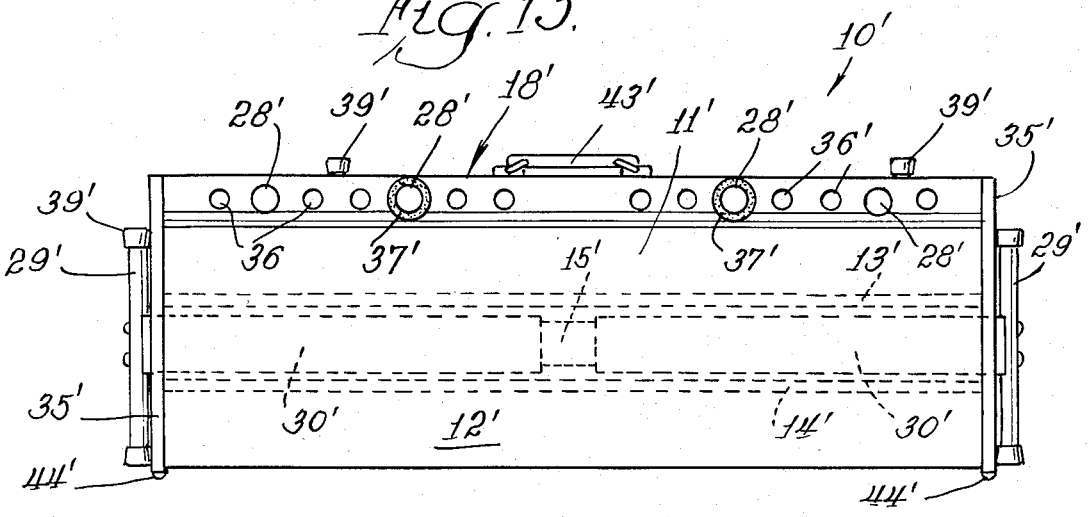

LOWER EXTREMITY EXERCISER

BACKGROUND AND SUMMARY OF THE INVENTION

The invention disclosed is directed toward an improved exercise board device having particular use for exercising the lower extremities in the course of a rehabilitation program.

Devices for promoting physical fitness and rehabilitation have in recent times taken a variety of sophisticated forms. With the increasing interest in sports medicine and treatment of sport-related injuries, such devices have become widely used for strengthening the body in order to prevent injuries and in rehabilitative programs designed to remedy ailments after injuries occur.

The kinds of apparatus oftentimes used in these programs include resistance-type mechanisms in which the user extends or contracts a particular muscle against increasing mechanical resistance. Conventional weight training is widely used, but many individual weight machines have been replaced by composite exercise stations in the form of large multipurpose mechanical devices. In this type of device a variety of movable bars and levers usually associate with pulleys that are linked to a series of weights, and the weights are constrained to move in a defined path. Adjustment of weight is typically achieved by selectively linking a greater or lesser number of weights in the series.

Certain beneficial exercises for the lower extremities, i.e., the feet, ankles, calves, knees, and upper leg, include: straight pathway dorsiflexion of the toes; heel inversion; heel eversion; heel supination; and, foot rotation. The use of wide elastic bands is particularly well suited for these kinds of exercises. A need has arisen for providing a device which enhances the benefits achieved by use of elastic bands. It is very helpful for the user to be able to quickly change band positions for implementation of different exercises.

Some early techniques using elastic bands involved looping them around table legs, or other supports, and then moving the leg or ankle away from the support to work against tension. A rudimentary board device concept for elastic bands involved a planar seat with interchangeable vertical band supports in the form of socket insertable pegs and a fixed horizontal T-shaped band support. This device is illustrated in a book written by one of the inventors and Dr. Richard H. Dominquez, entitled "TOTAL BODY TRAINING", published in 1982. The board device enabled the user to perform a number of exercises directed to the lower extremities, but it did not permit the horizontal positioning of band supports and further did not provide interchangeable supports usable for both vertical and horizontal positions. Moreover, the device did not envision a slidable bar means having a latching means to permit securement at a desired extended position. Storage chambers for holding extra support members and a chamber for accommodating a slidable bar means interiorly of the device, were not provided. An important element is exercising the lower extremities involves supporting the ankle in a way that allows the heel to be freely movable, rather than making the individual roll on the heels. This previous device did not include an ankle support feature.

It is therefore a goal of the invention to provide an improved lower extremity exercise board device which is capable of supporting elastic bands in numerous orientations for a variety of exercises.

It is a subservient object of the invention to provide an exercise board device which offers the improvement comprising adjustable means for repositioning elastic bands in diverse orientations.

It is an allied goal of the invention to provide the improvement comprising ankle support means for properly positioning the heels during certain exercises.

It is a concomitant goal to provide ankle support means in association with slide-extendable band supports and also in association with interchangeable horizontal and vertical band supports.

It is additionally a goal of the invention to provide an improved exercise board device which is relatively small, compact portable and has interior storage means for band engageable members.

The invention may be summarized as comprising an improved exercise board device of the type having a generally planar bed member forming a body supportable surface, and peg-insertable vertical sockets. The improvement in part comprises at one edge of the bed member an edge support member forming a depressed shoulder, or ledge. Along the shoulder a plurality of receiving sockets are provided for the removable positioning of peg members in an upright manner. Along a vertical edge surface adjacent the shoulder, the improvement further comprises a plurality of horizontal receiving apertures also adapted for the removable positioning of peg members. Peg members may be inserted in selected sequences within the sockets and apertures. The peg members each having a length sufficient for an elastic band to be looped or otherwise engaged therearound when inserted. The user's thighs, calves, ankles, feet, et al., are then placed inside the bands. Motion away from a peg member will provide elastic resistance during exercise. The improvement may further be summarized as providing support means for the bed member which form an open-ended channel. Within the channel a horizontal slidable bar means is movably positioned and may be moved outwardly from an edge of the device to a desired position relative to the bed member. The slidable bar means is provided with upward facing latching means cooperative with opposing latching means associated with the bed member, whereby a selected position of the slidable bar means may be maintained when an upward force component is applied. The slidable bar means includes band-engageagle end portions for attachment to elastic band members in the same general manner as with the peg members.

BRIEF DESCRIPTION OF THE DRAWINGS

For purposes of explaining an illustrative embodiment of the invention in a mode best known to the inventors, drawings are provided wherein:

FIG. 5 is a perspective view of the board device of FIG. 1 showing utilization of two elastic bands with the slidable bar means during an exercise;

FIG. 6 is another perspective view of the device showing utilization of two elastic bands and four inserted peg members positioned in vertical receiving sockets during an exercise;

FIG. 7 shows another exercise using the arrangement as in FIG. 6.

FIG. 8 is a partial perspective view of the device showing another exercise utilizing one elastic band and two peg members disposed in the vertical sockets;

FIG. 9 shows a different exercise utilizing the same arrangement as in FIG. 8;

FIG. 10 is a perspective view of the board device wherein a seated individual performs an exercise utilizing two elastic bands and two peg members inserted in horizontal receiving apertures;

FIG. 11 shows a utilization of the exercise board device wherein slidable bar means extend from opposite edges of the device with the user lying therebetween for performance of yet another exercise;

FIG. 12 shows an optional skid-resistant cushion usable with the exercise board device for comfortably positioning the user adjacent the device during exercise; and, FIG. 13 shows an alternate preferred embodiment for the exercise board device which is very compact and provides about one-half the width of the device as shown in FIGS. 1–11.

DESCRIPTION OF AN EXAMPLE EMBODYING THE BEST MODE OF THE INVENTION

Figure 1:
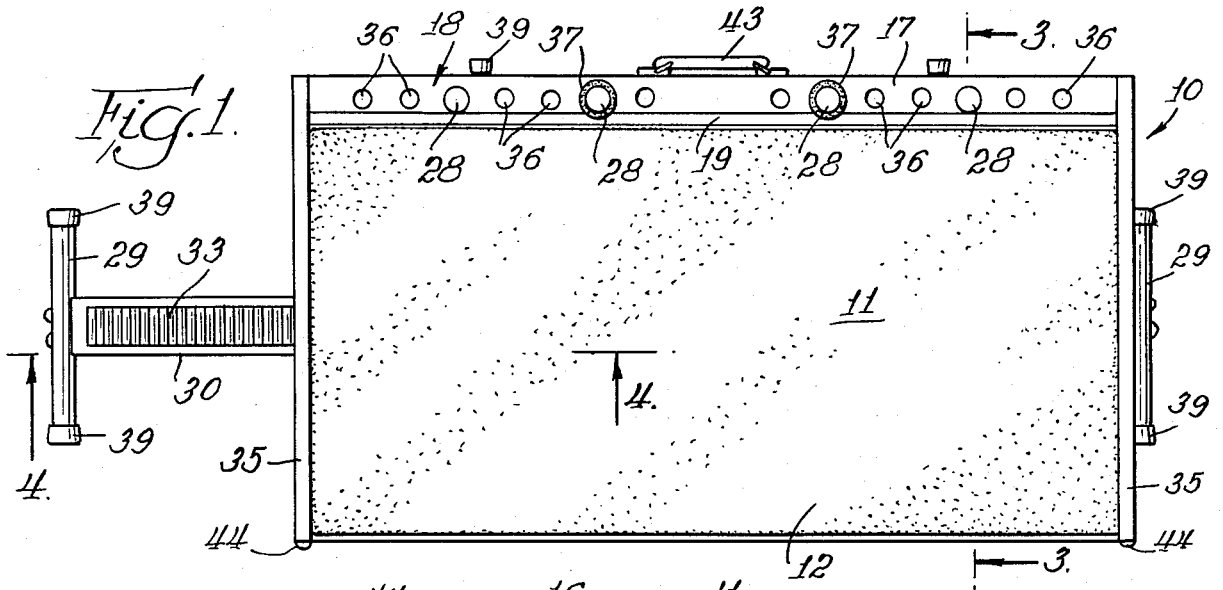
FIG. 1 is a plan view of the exercise board device embodying the invention.

The improved lower extremity exerciser forming the invention is embodied in the board device generally denoted at 10 in the drawings. Device 10 includes a generally planar bed member 11 which is preferably rectangular in plan and covered by a soft padding 12 on which the user may rest. Bed member 11 is constructed of sturdy material and in the exemplary embodiment comprises birchwood for substantial stability and strength. The bed member 11 is supportable on a floor, or other planar surface, by support means including elongate members 13, 14, which are parallel and spaced apart to either side of the long axis of bed member 11. A central channel 15 is formed therebetween. Extending generally below one long edge, an elongate support member 16 is positioned parallel to members 13, 14. Supports 13, 14 and 16 have about the same width and height. Below the opposite long edge of bed member 11, the support means further includes a wider support member 17, which also extends edge-outwardly to form a depressed shoulder 18 with the adjacent edge of bed member 11 and padding 12. A metal L-angle 19 is mechanically fastened along shoulder 18 and rigidly connects bed member 11 to support member 17. Members 13, 14, 16, 17, are otherwise affixed to bed member 11 by means of mechanical fasteners, adhesives, or the like.

The support means for bed member 11 additionally includes transverse shorter members 20–23. Members 20, 21 are disposed generally below one shorter edge and are spaced to either side of channel 15. Similarly, at the opposite shorter edge of bed member 11, members 22, 23 are spaced to either side of channel 15. Channel 15 is accordingly open-ended. Support members 20–23 may likewise be affixed to panel 11 by mechanical fasteners, adhesives, or the like. The support members 13, 14, 16, 17, 20–23 form storage chambers 24, 25 at either side of channel 15. Channel 15, and storage chamber 24, 25 are downwardly open at the bottom, or floor-facing side, of device 10.

Skid resistant means 26 is secured to undersurfaces of the support members and preferably take the form of VELCRO material so that device 10 may be used on carpeting and resist lateral movement. Other well-known skid resistant materials may be utilized, such as ridged rubber strips.

Figure 2:
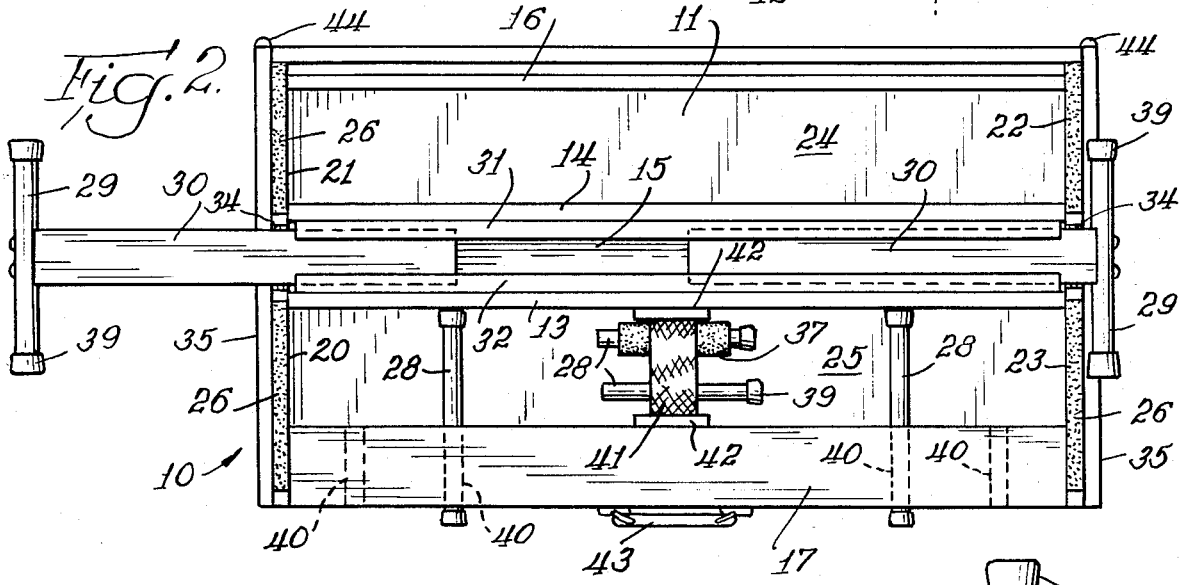
FIG. 2 is a bottom view of the device as shown in FIG. 1.
Figure 3:
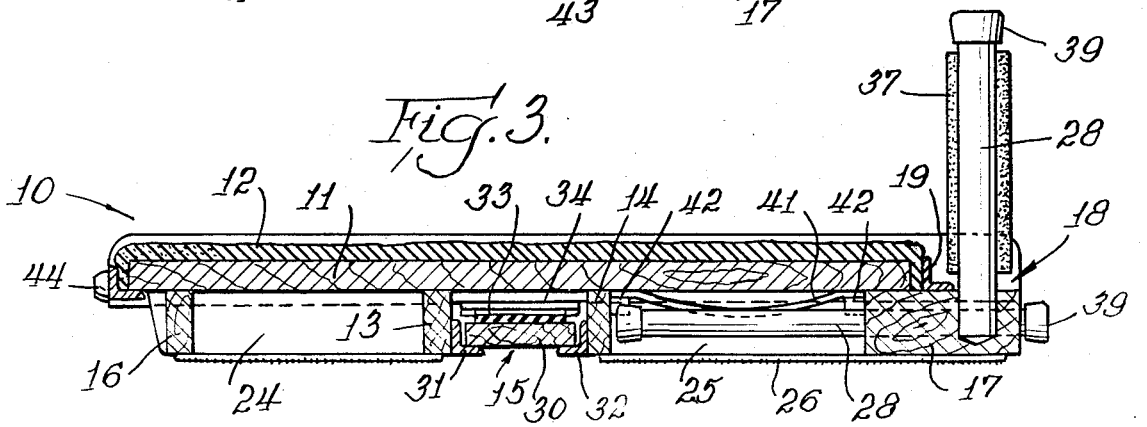
FIG. 3 is a sectional view taken along line 3—3 of FIG. 1.

The invention offers a significant benefit for exercise programs in that it is capable of positioning endless elastic bands, generally shown at 27, in a variety of locations. Change from a position suitable for one exercise to that suitable for another is simple and fast. This variability is provided by band-engageable members which can be adjusted to innumerable orientations. The band-engageable means comprise peg members 28 and T-bars 29. T-bars 29 are affixed at ends of slidable bar means 30, best viewed in FIGS. 1 and 2. Slidable bar means 30 reside within channel 15 in movable relation thereto and are supported by metal L-angles 31, 32. The L-angles 31, 32 are affixed channel-interiorly to elongate members 13, 14, respectively, as best shown in FIG. 3. In the exemplary embodiment, slidable bar means 30 comprise two elongate wood bars, which are preferably rectangular in cross-section. Each has a length that is approximately one-half the length of panel 11 such that means 30 can be compactly retracted within channel 15 to dispose T-bars 29 against members 20–23, as is shown at the righthand side of FIG. 2 for one of the T-bars. When required, means 30 can be extended outwardly of channel 15, as illustrated at the lefthand sides of FIGS. 2 and 4.

Figure 4:
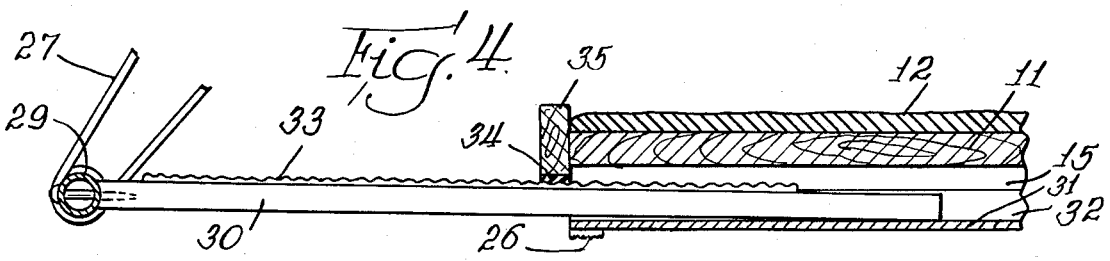
FIG. 4 is a partial sectional view taken along line 4—4 of FIG. 1.

Upper surfaces of bar means 30 are provided with a ridged latching surface 33. Surface 33 in the disclosed embodiment comprises an adhesively secured corrugated rubber pad having numerous transverse ripples forming peaks and valleys. The surface 33 latchingly mates with a similarly formed surface 34 at the undersurfaces of cross members 35. Cross members 35 are affixed to the edges of the two shorter sides of bed member 11 and extend above padding 12 to create a raised ankle supporting upper surface, as shown in FIGS. 4 and 5. It should be noted that shoulder 18 similarly provides means for ankle support during exercise procedures, as will be explained with respect to FIGS. 6–9. When slidable bar means 30 is extended outwardly of channel 15, and a vertical component of force is applied by the user pulling against bands 27 looped around T-bar 29, the surfaces 33 and 34 matingly latch to one another. This latch-like action keeps bar means 30 at the pre-selected extended position, as illustrated in FIG. 4.

Peg members 28 may be selectivley used in vertical and horizontal arrangements. The vertical position is made possible by the provision of sockets 36 drilled into member 17. Sockets 36 are spaced apart along member 17 to offer a variety of insertable positions. During certain exercises, the ankles, feet, legs, etc., are braced against usually two peg members. In order to provide a comfortable cushion, the appropriate peg members are provided with removable sleeve 37 formed of a soft material, such as a foamed plastic, rubber, or the like.

End caps 39 are frictionally fitted to the upper ends of the vertically disposed peg members 28. Caps 39 serve the purpose of preventing bands 27 and sleeves 37 from sliding off the pegs. Caps 39 also protect the user from abrasive contact with the ends of the pegs, since preferably they comprise hollow steel tubes and may have a relatively sharp upper rim. T-bars 29 also have caps 39 at opposite ends for maintaining the position of bands 27, as well as offering this protective measure.

Opening at the outward vertical face of member 17, apertures 40 enable the horizontal placement of peg members 28. Pegs 28 are slidably disposed in apertures 40 and are extended outwardly of member 17 for use. As shown in FIG. 3, peg members 28 can be retracted to partially reside within chamber 25 for storage. For the horizontal orientation, pegs 28 are provide with friction-fit caps 39 at both ends. The inner cap 39 acts as a limit stop preventing unintended complete horizontal dislocation of a peg 28 from an aperture 40. The length of peg members 28 is slightly greater than the distance between elongate support member 14 and the outer vertical surface of wider member 17, which allows the cap-fitted outer end portion to extend outwardly of member 17 when the peg member is fully retracted, as in FIG. 3. The outer cap 39 may therefore be grasped by the user to pull the peg outward for use and also serves to keep a band 27 in place and provide the aforementioned protection.

In the illustrative embodiment, peg members 28 are all substantially identical and are interchangeable from the horizontal to the vertical position as needed. Since caps 39 are fully removable from peg members 28, a peg member 28 in the horizontal orientation, is, by the exertion of a slight pulling force, disengageable from the inner cap. This allows a removed peg 28 to be re-positioned vertically in a socket 36. Upon completion of use in the vertical position, the peg 28 may be returned to the horizontal position by passing it through an aperture 40 of member 17, and then re-placing the interior cap 39. Because storage chamber 25 opens to the floor-facing side of device 10, access is granted to the inner ends of the pegs. Thereby, a minimum number of peg members is required. The weight and the number of components are both thereby reduced. Alternatively, two sets of different-sized, or shaped, pegs may be used, wherein one set fits sockets 36 and the other fits apertures 40. T-bars 29 are also illustrated to be metal tubes having the same diameter as peg members 28, but these similarities are not necessary for practice of the invention.

A sufficient number of peg members 28 are provided so that a variety of arrangements can be obtained. It is envisioned that six peg members will offer a suitable amount for most exercise programs. When a certain exercise does not require use of all the pegs, the extras may be readily stored within storage chambers 24 or 25. In the disclosed embodiment, a resilient strap 41 is stretched across storage chamber 25 adjacent the underside of bed member 11 and is connected at its opposite ends by mechanical holders 42 to members 14, 17. Pegs are resiliently held between the strap 41 and bed member 11. Additional strap and holder means may be provided in chamber 25, or in storage chamber 24.

Cross members 35 may optionally include support feet 44 at ends thereof, as shown in FIG. 1. Feet 44 may be made of rubber, plastic, or other suitable material, which allows exercise device 10 to be safely positioned on edge when stored or transported.

The invention can be used almost anywhere, which is particularly critical for maintaining an ongoing rehabilitation program. Exercise board device 10 can be hand-carried and in the disclosed embodiment has a width of about 24 inches and length of about 44 inches. A convenient handle 43 is centrally affixed along the edge of member 17 for carrying much like an attache case. The inventive lower extremity exerciser offers the convenience of being usable in the home or office, as well as in the gymnasium. Storage of the slidable bar means and peg members make device 10 compact during transport. The exercise device is also relatively thin and, with reference to FIG. 3, the vertical dimension from padding 12 to the skid resistant surface 26 is approximately 2½ to 3 inches in the exemplary embodiment.

An even more compact version of the exercise device is shown at FIG. 13. In corresponding prime numbers, device 10' is shown having substantially the same construction as device 10 with the exception of the width being reduced by about one-half. Chambers, corresponding to chambers 24, 25 of device 10, are also provided, but are narrower in this embodiment. Pegs 28', slidable bar means 30', cushion sleeves 37' and caps 39' are similarly provided. The tips of the arms 29', having caps 39', are in closer proximity to the long edges of device 10' than i in 10, but do not project outwardly beyond these edges. Device 10' is very compact and transportable without awkward outwardly extending projections. A convenient handle means 43' is disposed along member 17' for easy carrying. Although narrower, this embodiment of the invention permits the performance of the exercise techniques explained hereinafter with reference to FIGS. 5–11. It is envisioned that this ultra-compact size readily permits the exercise device to be carried and stored aboard an airplane during travel ready for use at a hotel or other destination. An exercise program may thus be continued without interruption wherever the individual may be.

EXAMPLES OF EXERCISES USING THE INVENTION

With particular reference to FIGS. 5–11, a series of specific exercise procedures are depicted using device 10. Certainly, those involved in physical fitness and rehabilitation programs would find numerous other exercises and ways to use the invention.

FIG. 5 shows a person sitting longitudinally of device 10 during the performance of a straight pathway dorsiflexion exercise. Two endless elastic bands 27 are disposed around arms of a T-bar 29 associated with a slidable bar means 30 extended outwardly to the desired position. The latching action of surfaces 33 and 34 helps retain the position, since during the course of this exercise a vertical force component is exerted. The elastic bands 27 are placed over the instep of each foot and the exercise is performed by pulling the toes generally toward the head. Increased tension occurs as the toes move farther from T-bar 29. The invention makes proper orientation of the heels possible by the provision of cross members 35. Since cross members 35 extend above the upper surface of pad 12, the heels are freely movable while the ankles are supported atop member 35. This also permits the legs to be comfortably straightened to achieve the greatest benefit from the exercise. During this exercise, peg members 28 can be kept in the storage chambers.

FIG. 6 shows an individual with his legs resting on padding 12 while being seated on a cushion 45. Cushion 45 is shown in FIG. 12 and has a skid resistant bottom surface 46, similar to surface 26. For this exercise, known as heel supination, four of the pegs 28 are utilized. The inner two pegs are provided with cushion sleeves 37 and the outer two pegs are engaged by elastic bands 27 placed therearound. With both feet between the two inner pegs 28, the outer sides of the ankles are each braced against a sleeve 37 for comfortable support. Shoulder 18 serves substantially the same purpose as raised cross members 35 whereby the ankles rest on padding 12 to support the feet, while the heels are freely movable therebelow at shoulder 18. Thus, the exercise is most beneficially performed by avoiding rolling on the heels. The exercise is accomplished by pointing the feet upwardly (dorsiflexion) and then rotating the feet outwardly to inwardly. Muscles on the inner side of the calves are worked in this manner. The exercise is best performed by placing the legs apart to form an angle of about 45°. With the plurality of sockets 36 a variety of peg spacings may be selected to accommodate a particular body size in the correct position.

FIG. 7 illustrates a heel inversion exercise, again utilizing four peg members 28. The individual is seated in about the same position as in FIG. 6. The inner two pegs 28 are also provided with cushion sleeves 37 and the endless elastic bands are again looped around the outer pegs 28. In this exercise the feet are held in static supination. With the heels resting at shoulder 18 atop member 17, and by rolling the foot bottom-inwardly, the inner side muscles of the calves are exercised. Tension may be increased by pulling the body farther away from the pegs 28.

In FIG. 8, only two pegs 28 are required and both are provided with sleeves 37. The exercise shown is known as heel eversion. Only a single elastic band 27 is used, and engages only the feet, not the pegs. This exercise is somewhat similar to the one illustrated that in FIG. 7 except that the foot is held to the outer sides of the cushioned pegs in static pronation. Because pronation is an outward rolling of the heel, the outer muscles at the ankle, the peroneal muscles, are exercised.

In FIG. 9, as in FIG. 8, two pegs 28, having sleeves 37, are used. The individual also sits crosswise of device 10 with legs fully straightened. One elastic band 27 is disposed around the feet, as in the heel eversion, but not around pegs 28. The exercise, called heel pronation, is performed by turning the inside edges of the feet outwardly, holding the position for a time, and then slowly returning to the original position. The heels are again properly positioned on shoulder 18, below the ankles, which rest on the upper surface of pad 12.

FIG. 10 shows another exercise for the calf muscles whereby two pegs 28 are extended outwardly from two apertures 40 at a pre-selected spacing. The individual is seated on a chair with his feet mainly placed atop pad 12, but the heels initially rest on the depressed shoulder 18. Two elastic bands 27 are each looped around a peg 28 and are interconnected by a conventional belt or leather strap placed across the thighs. In this position the individual works against the resistance of the bands by pushing upwardly from the toes to raise his heels from shoulder 18. The remaining, or extra, pegs 28 are stored within chamber 25, and slidable bar means 30 are retracted within channel 15.

In FIG. 11, bar means 30 are both extended outwardly of device 10 and an elastic band 27 is looped around each T-bar 29. At one side, a band 27 is placed around the ankles, and at the other side, a band 27 is placed around the wrists. The exercise is performed by raising the arms or legs, or both, upwardly from the T-bars. As the legs or arms are raised, a resulting vertical component of force at the respective T-bar causes the latching action of surfaces 33 and 34 to occur.

ACHIEVEMENTS OF THE INVENTION

Accordingly, there is provided an exercise board device well suited for the lower extremities. The peg members can be selectively positioned in horizontal and vertical arrangements for the performance of a wide variety of exercises and accommodate almost any body size. The slidable bar means can be moved from retracted positions to be disposed at predetermined positions relative to the sides of the exercise device. Elastic band members can simply be re-positioned on the peg members and the band engageable ends of the bar means in a multitude of orientations. Storage is provided for peg members when they are not required. The device is relatively flat, and becomes very compact when the bar means and horizontal peg members are fully retracted. The exercise device may be transported for use almost anywhere to allow the individual to maintain a day-to-day exercise regimen.

What is claimed is:

1. In a lower extremity exercise board device of the type for use with endless elastic bands including a planar bed member closely associating with a plurality of vertical sockets for receiving band engageable peg members, the improvement comprising:

support means associating with the undersurface of the bed member forming an open-ended channel and at least one storage chamber to a side of the channel, said support means including;

an elongate support member rigidly connected to the bed member to be supportively arranged at the undersurface of the bed member and extend outwardly of the bed member along one edge thereof and generally parallel to said channel, said support member having an upper horizontal surface including a plurality of spaced-apart vertical sockets having axes at generally right angles to said planar bed and an external vertical edge surface including horizontal spaced-apart apertures having axes at generally right angles to the socket axes, said upper horizontal surface forming a depressed shoulder with respect to the edge of said bed member;

a slidable bar means movably arranged within said channel and terminating at an outward end thereof in band-engageable means, the bar means being movable outward of said channel to position said outward end at a pre-selected distance from said bed member;

latching means associated with said slidable bar means capable of securing the bar means at pre-selected positions from the bed member;

a plurality of band engageable peg members insertably cooperative with said vertical sockets and horizontal apertures wherein peg members are sized to be vertically held upon insertion at said sockets, and horizontally held when inserted at said apertures, wherein said peg members are capable of being selectively insertable to provide for a variety of band arrangements for different exercises; and, securement means associated with said storage chamber means capable of removably storing peg members;

wherein said improved device provides for a removably looping engagement of endless elastic bands around said peg members and band-engageable means without mechanical fastening of bands, and wherein said peg members and slidable bar means enable the device to be selectively arranged for a wide variety of band orientations.

2. An improved exercise board device as in claim 1 including removable cushioned sleeve members capable of removably engaging around said peg members.

3. An improved exercise board device as in claim 1 wherein said bed member is generally rectangular in plan.

4. An improved exercise board device as in claim 3 wherein said elongate support member forms said shoulder with a long edge of the generally rectangular bed member.

5. An improved exercise board device as in claim 4 wherein said channel is generally centered between the long edges of the bed member and has opposite open ends below the shorter edges thereof.

6. An improved board device as in claim 5 wherein a cross member is arranged along a shorter edge of the bed member and extends upwardly therefrom forming a raised resting surface higher than the plane of said bed member.

7. An improved exercise board device as in claim 6 wherein said latching means comprises opposing ridged surfaces of the slidable bar means and cross member, said cross member ridged surface being arranged adjacent an open end of said channel, and said slidable bar means having said ridged upper surface for a major portion of its length, whereby upon experiencing a vertical force the bar means contacts the cross member and said ridged surfaces latchingly mate to thereby retain said slidable bar means to the undersurface of said cross member at a pre-selected distance from the bed member.

8. An improved exercise board as in claim 1 wherein said support means is adaptable for supporting said device on a generally planar surface, and having skid resistant means along undersurfaces thereof.

9. An improved exercise board device as in claim 1 wherein at least one said horizontal aperture extends through said elongate support member and a peg member is capable of being slidably held therein whereby to enable the peg member to be retracted inwardly of said vertical edge surface for a major portion of the length of the peg member.

10. An improved exercise board device as in claim 1 wherein the bandengageable means of said slidable bar means comprises a transverse member forming a T-shape.

11. An improved exercise band device as in claim 5 wherein a pair of slidable bar means are longitudinally arranged within said channel and being separately movable outwardly and inwardly from said opposite channel open ends.

* * * * *

UNITED STATES PATENT AND TRADEMARK OFFICE

CERTIFICATE OF CORRECTION

PATENT NO. : 4,492,376

DATED : January 8, 1985

INVENTOR(S) : Jack M. Schatz, Robert S. Gajda

It is certified that error appears in the above–identified patent and that said Letters Patent are hereby corrected as shown below:

Column 1, line 61, immediately following the word "element" please delete the word "is" and insert therefor --in--.

Column 6, line 16, immediately preceding the word "in" please delete the single letter " i ".

Signed and Sealed this

*Thirtieth* Day of *July 1985*

[SEAL]

*Attest:*

DONALD J. QUIGG

*Attesting Officer* *Acting Commissioner of Patents and Trademarks*